US009774957B2

(12) United States Patent
Zhang

(10) Patent No.: US 9,774,957 B2
(45) Date of Patent: Sep. 26, 2017

(54) MULTI-DRIVER TRANSDUCER HAVING SYMMETRICAL MAGNETIC CIRCUIT AND SYMMETRICAL COIL CIRCUIT

(76) Inventor: Fan Zhang, Guangdong (CN)

( * ) Notice: Subject to any disclaimer, the term of this patent is extended or adjusted under 35 U.S.C. 154(b) by 0 days.

(21) Appl. No.: 14/416,025

(22) PCT Filed: Jul. 20, 2012

(86) PCT No.: PCT/CN2012/000977
§ 371 (c)(1),
(2), (4) Date: May 26, 2015

(87) PCT Pub. No.: WO2013/010384
PCT Pub. Date: Jan. 24, 2013

(65) Prior Publication Data
US 2015/0271605 A1 Sep. 24, 2015

(51) Int. Cl.
*H04R 1/02* (2006.01)
*H04R 9/06* (2006.01)
*H04R 9/04* (2006.01)
*H04R 9/02* (2006.01)

(52) U.S. Cl.
CPC ..... *H04R 9/063* (2013.01); *H04R 9/025* (2013.01); *H04R 9/04* (2013.01); *H04R 9/043* (2013.01); *H04R 2209/041* (2013.01)

(58) Field of Classification Search
CPC ..... H04R 9/025; H04R 2209/024; H04R 2209/041
See application file for complete search history.

(56) References Cited

U.S. PATENT DOCUMENTS 8,781,150 B2 * 7/2014 Babb ..... H04R 9/022 381/397
9,277,325 B2 * 3/2016 Zhang ..... H04R 9/025
2012/0020479 A1 * 1/2012 Zhang ..... H04R 9/025 381/17

FOREIGN PATENT DOCUMENTS

GB WO 0067523 A2 * 11/2000 ..... H04R 9/025

* cited by examiner

*Primary Examiner* — Quoc D Tran
*Assistant Examiner* — Ryan Robinson

(57) ABSTRACT

A multi-driver transducer having symmetrical magnetic circuits and symmetrical coil circuits, wherein one or more pieces of circular or annular partitions made of a non-magnetic material are used to bond two or more sets of dual magnetic gap and dual coil driver units (01 or 02) into one integrated magnetic core. Four or more coaxial isodiametric annular magnetic gaps are formed between the inner circumferential face or outer circumferential face of one or two tubular magnetic yokes embedded in an open-end tubular thin wall of the bracket and the vertical circumferential face of an upper pole plate and a lower pole plate of the magnetic core, four or more coaxial and isodiametric coils are inserted in the four or more coaxial and isodiametric annular magnetic gaps, and the winding direction, connection manner, and necessary technical features of the coils are governed; thus, the multi-driver transducer having one or more pairs of mutually-repelling magnets, symmetrical magnetic circuits, and symmetrical coil circuits is constituted. Back electromotive force and inductance acquired via induction by the transducer during the working process are mutually offset. The transducer has resistive load features or near-resistive load features, and has super-high sensitivity, high resolution, and high-fidelity quality.

7 Claims, 8 Drawing Sheets

MULTI-DRIVER TRANSDUCER HAVING SYMMETRICAL MAGNETIC CIRCUIT AND SYMMETRICAL COIL CIRCUIT

FIELD OF THE INVENTION

The present invention relates to a multi-driver transducer, in particular to a multi-driver transducer having mutually-repelling magnets, symmetrical magnetic circuits, and symmetrical coil circuits, and belongs to the electrical field of electroacoustic transducers and electromechanical transducers.

BACKGROUND OF THE INVENTION

A main-stream conventional electroacoustic transducer or electromechanical transducer only has one magnetic gap and one coil, which constitute a moving-coil type driver. A multi-driver transducer having mutually-repelling magnets has two or more magnetic gaps and two or more coils, which constitute two or more moving-coil type multi-driver transducers.

Multi-driver transducers having mutually-repelling magnets belong to an existing technique. For example, in the technical solutions proposed by the inventor in PCT/CN98/00306, PCT/CN2008/072668, PCT/CN2009/070507, CN99114781.2, and TW88109796, etc., wherein moving-coil type multi-driver dynamic loudspeakers having one or more pairs of mutually-repelling magnets are disclosed. In JP09322294A, a three-driver technical solution comprising a pair of mutually-repelling magnets, three magnetic gaps, and three coils is proposed. The advantage of these technical solutions is that the transducer has high efficiency and strong driving power, but a drawback of them is that the transducer still has inductive load features and back electromotive force, resulting in high total harmonic distortion in the transducer, especially a woofer or subwoofer, wherein, at 1 W/1 m, it is hard for the total harmonic distortion (THD+N) to meet the criterion specified in the Chinese national standard of smaller than or equal to 6%, and the total harmonic distortion often reaches as high as 10%43% or even higher.

SUMMARY OF THE INVENTION

A first object of the present invention is to overcome the drawbacks in the prior art and a technical prejudice formed in the technical field of electroacoustics, and utilize two sets of symmetrical magnetic circuits and symmetrical coil circuits in the transducer or loudspeaker that has resistive load features or near-resistive load features in the technical solutions as disclosed by the inventor in CN200610020317.7, PCT/CN2008/072668, US2005/0099255A1, CN200510091936.0, CN200810169693.1, and PCT/CN2009/070507, etc. to constitute a transducer having a pair of mutually-repelling magnets and four drivers. Among the four sets of symmetrical magnetic circuits and symmetrical coil circuits in the transducer, every two sets of symmetrical magnetic circuits and symmetrical coil circuits can mutually offset the inductance of the coil circuits themselves in the transducer and back electromotive force acquired via induction, and thereby the total harmonic distortion of the four-driver transducer is improved unprecedentedly while great driving power and super-high efficiency are obtained in the transducer, wherein, the THD+N can be smaller than or equal to 3% and meet the Hi-Fi criterion for loudspeakers.

A second object of the present invention is to overcome the drawbacks in the prior art and a technical prejudice formed in the technical field of electroacoustics, and utilize two sets of six or more separately installed symmetrical magnetic circuits and symmetrical coil circuits in a transducer or loudspeaker that has resistive load features or near-resistive load features in the above technical solutions disclosed by the inventor to constitute a transducer having one or more pairs of mutually-repelling magnets and six drivers and more drivers in an even number, and thereby the total harmonic distortion of the transducer with six-driver, or 8-driver, or 10-driver can be improved unprecedentedly while much greater driving power and super-high efficiency are obtained in the transducer, wherein, the THD+N is expected to be smaller than or equal to 3%, and almost meets the Hi-Fi criterion for loudspeakers.

A third object of the present invention is to overcome the drawbacks in the prior art and a technical prejudice formed in the technical field of electroacoustics, and enable a small-diameter loudspeaker for example a 2-3 inches loudspeaker, to deepen its $F_0$ to a lower frequency and obtain an excellent base sound reproduction effect, by substantially increasing the linear stroke of the loudspeaker while providing a technical solution for super-high driving power.

The objects of the present invention are attained as follows:

A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitute coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils;

The frame is a frame made of a non-magnetic material, or the frame and the bracket are integrated into an integral frame;

The magnetic circuit has coaxially installed upper pole plate and lower pole plate, and the pole plates have the same thickness and the same projected area and match a permanent magnet; the permanent magnet is one or more uniform-thickness, uniformly distributed, and axially charged permanent magnets which bind the upper pole plate and lower pole plate into an integrated magnetic core;

The bracket is a bracket made of a non-magnetic material, with an inwardly protruding circular platform arranged at its central axis part, the circular platform has a smooth and regular vertical circumferential face, with an annular groove arranged in the outer side of the vertical circumferential face, the annular groove has two or more evenly distributed air venting through-holes in its bottom, the outer side of the annular groove constitutes an open-end tubular thin wall of the bracket, a smooth and a regular horizontal positioning face and vertical positioning face are arranged on the inner circumferential face of the tubular thin wall at a corresponding height in axial direction or on its top, and the tubular thin wall of the bracket is arranged on its top with a flange extending outwards and coupled to the frame;

The upper pole plate, permanent magnet, and lower pole plate are fixed by bonding to the central axis part of the circular platform face of the bracket, a tubular magnetic yoke coaxially mounted with the upper pole plate, permanent magnet, and lower pole plate is flush-mounted or fixed by bonding to the inner circumferential face of the tubular thin wall of the bracket, and is positioned by bonding or fixed by coupling with the vertical positioning face and horizontal positioning face, the other end of the tubular magnetic yoke is embedded in the circular axial hole in the bottom of the frame and is fixed by binding or bonding to the frame, the two horizontal end faces of the tubular magnetic yoke go beyond the outer polar face of the upper pole plate and the lower pole plate by 0.5-20 mm of value H respectively in axial height, two coaxial isodiametric annular magnetic gaps are formed between the inner circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces F in the same direction at a working moment;

With the bisector axis X-X at half axial height of the permanent magnet as a horizontal symmetry axis and the central axis Y-Y of the upper pole plate, permanent magnet, and lower pole plate as a vertical symmetry axis, the dual magnetic gap and dual coil driver has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same tension when winding, and the inductances of the two coils and the back electromotive forces induced in the two coils during the reciprocating movement of the two coils offset each other due to the phase angle of 180 degree; thus, a first set of dual magnetic gap, dual coil, and inner magnet driver unit 01 having resistive load features or near-resistive load features is constituted;

A piece of coaxial circular or annular partition made of a non-magnetic material in appropriate thickness is bonded to the outer side of the lower pole plate of the first set of dual magnetic gap, dual coil, and inner magnet driver unit 01, and the other side of the circular or annual partition is fixed by bonding to the lower pole plate of a second set of dual magnetic gap, dual coil, and inner magnet driver unit 01 of the transducer; thus, two sets of dual magnetic gap, dual coil, and inner magnet driver unit 01 having mutually-repelling magnets are formed; in that way, another piece of coaxial circular or annual partition made of an non-magnetic material in appropriate thickness is bonded to the outer side of the upper pole plate of the second set of dual magnetic gap, dual coil, and inner magnet driver unit 01, and the other side of the circular or annular partition is fixed by bonding to the upper pole plate of a third set of dual magnetic gap, dual coil, and inner magnet driver unit 01 of the transducer; the first set, second set, third set, . . . , of dual magnetic gap, dual coil, and inner magnet driver unit 01 take the same central axis Y-Y as their vertical symmetry axis, and have the same coil framework, the same frame and bracket, the same tubular magnetic yoke, the circular or annular partitions in the same physical dimensions, four, six, or more annular magnetic gaps and four, six, or more coils matching the annular magnetic gaps; thus, a super-high sensitivity, high fidelity, and inner magnet multi-driver transducer having one or more pairs of mutually-repelling magnets, symmetrical magnetic circuits, and symmetrical coil circuits is constituted.

A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitute coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils;

The frame is a frame made of a non-magnetic material, or the frame and the bracket are integrated into an integral frame;

The magnetic circuit has coaxially installed upper pole plate and lower pole plate that have at least one axial center hole respectively, and the pole plates have the same thickness and the same projected area and match a permanent magnet; the permanent magnet is one annular permanent magnet with an axial center hole or one or more uniform-thickness, uniformly distributed, and axially charged permanent magnets which bind the upper pole plate and lower pole plate into an integrated magnetic core;

A bracket is made of non-magnetic material, with an inwardly protruding circular platform arranged at the central axis part, the circular platform has a axial center hole that matches the upper pole plate, permanent magnet, and lower pole plate, and has a smooth and regular vertical circumferential face, with an annular groove arranged in the outer side of the vertical circumferential face, the annular groove has two or more evenly distributed air venting through-holes in its bottom, the outer side of the annular groove constitutes an open-end tubular thin wall of the bracket, a smooth and a regular horizontal positioning face and vertical positioning face are arranged on the inner circumferential face of the tubular thin wall at a corresponding height in axial direction or on its top, and the tubular thin wall of the bracket is arranged on its top with a flange extending outwards and coupled to the frame;

A fastener made of a non-magnetic material passes through at least one axial center hole of the upper pole plate, permanent magnet, and lower pole plate and secures and binds them on the central axis part of the circular platform face of the bracket, a tubular magnetic yoke coaxially mounted with the upper pole plate, permanent magnet, and lower pole plate is flush-mounted or fixed by bonding to the inner circumferential face of the tubular thin wall of the bracket, and is positioned by bonding or fixed by coupling with the vertical positioning face and horizontal positioning face, the other end of the tubular magnetic yoke is embedded in the circular axial hole in the bottom of the frame and is fixed by binding or bonding to the frame, the two horizontal end faces of the tubular magnetic yoke go beyond the outer polar face of the upper pole plate and the lower pole plate by 0.5-20 mm of value H respectively in axial height, two coaxial isodiametric annular magnetic gaps are formed between the inner circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces F in the same direction at a working moment;

With the bisector axis X-X at half axial height of the permanent magnet as a horizontal symmetry axis and the central axis Y-Y of the upper pole plate, permanent magnet, and lower pole plate as a vertical symmetry axis, the dual magnetic gap and dual coil driver unit has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same winding tension, and the inductances of the two coils and the back electromotive forces induced in the two coils during the reciprocating movement of the two coils offset each other due to the phase angle of 180 degree; thus, a first set of dual magnetic gap, dual coil, and inner magnet driver unit having resistive load features or near-resistive load features is constituted;

A piece of coaxial circular or annular partition made of a non-magnetic material in appropriate thickness is bonded to the outer side of the lower pole plate of the first set of dual magnetic gap, dual coil, and inner magnet driver unit 01, and the other side of the circular or annual partition is fixed by bonding to the lower pole plate of a second set of dual magnetic gap, dual coil driver, and inner magnet driver unit 01 of the transducer; thus, two sets of dual magnetic gap, dual coil and inner magnet driver unit 01 having mutually-repelling magnets are formed; in that way, another piece of coaxial circular or annual partition made of an non-magnetic material in appropriate thickness is bonded to the outer side of the upper pole plate of the second set of dual magnetic gap, dual coil, and inner magnet driver unit 01, and the other side of the circular or annular partition is fixed by bonding to the outer side of the lower pole plate of a third set of dual magnetic gap, dual coil and inner magnet driver unit 01 of the transducer; the first set, second set, third set, . . . , of dual magnetic gap, dual coil driver unit 01 take the same central axis Y-Y as their vertical symmetry axis, and have the same coil framework, the same frame and bracket, the same tubular magnetic yoke, the circular or annular partitions in the same physical dimensions, four, six, or more annular magnetic gaps and four, six, or more coils matching the annular magnetic gaps; thus, a super-high sensitivity, high fidelity, and inner magnet multi-driver transducer having one or more pairs of mutually-repelling magnets, symmetrical magnetic circuits, and symmetrical coil circuits is constituted.

A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitutes coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils;

The frame is a frame made of a non-magnetic material, or the frame and the bracket are integrated into an integral frame;

The magnetic circuit has coaxially installed annual upper pole plate and lower pole plate, and the pole plates have the same thickness and the same projected area and match a permanent magnet; the permanent magnet is one annular permanent magnet or one or more uniform-thickness, uniformly distributed, and axially charged permanent magnets bind the upper pole plate and lower pole plate into an integrated magnetic core;

A bracket is made of non-magnetic material, with an inwardly protruding annular platform arranged at the central axis part, the annular platform has an inwardly protruding column arranged at its central axis part, and has a smooth and regular vertical circumferential face, with an annular groove arranged in the outer side of the vertical circumferential face, the annular groove has two or more evenly distributed air venting through-holes in its bottom, the outer side of the annular groove constitutes an horizontal positioning face and an open-end tubular thin wall of the bracket, the inner circumferential face of the tubular thin wall is arranged with a vertical positioning face at a corresponding height in axial direction, and the tubular thin wall of the bracket is arranged on its top with a flange extending outwards and coupled to the frame;

The upper pole plate, permanent magnet, and lower pole plate are flush-mounted or fixed by bonding to the inner circumferential face of the tubular thin wall of the bracket, a tubular magnetic yoke coaxially mounted with the upper pole plate, permanent magnet, and lower pole plate is flush-mounted or fixed by bonding to the inwardly protruding column of the bracket and is horizontally positioned by the annular platform face, the two horizontal end faces of the tubular magnetic yoke go beyond the outer polar face of the upper pole plate and the lower pole plate by 0.5-20 mm of value H respectively in axial height, two coaxial isodiametric annular magnetic gaps are formed between the outer circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces F in the same direction at a working moment;

With the bisector axis X-X at half axial height of the permanent magnet as a horizontal symmetry axis and the central axis Y-Y of the upper pole plate, permanent magnet, and lower pole plate as a vertical symmetry axis, the dual magnetic gap and dual coil driver unit has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same winding tension, and the inductances of the two coils and the back electromotive forces induced in the two coils during the reciprocating movement of the two coils offset each other due to the phase angle of 180 degree; thus, a first set of dual magnetic gap, dual coil, and outer magnet driver unit 02 having resistive load features or near-resistive load features is constituted;

A piece of coaxial circular or annular partition made of a non-magnetic material in appropriate thickness is bonded to the outer side of the lower pole plate of the first set of dual magnetic gap, dual coil, and outer magnet driver unit 02, and the other side of the circular or annual partition is fixed by bonding to the lower pole plate of a second set of dual magnetic gap, dual coil, and outer magnet driver unit 02 of the transducer; thus, two sets of dual magnetic gap, dual coil, and outer magnet driver unit 02 having mutually-repelling magnetic features are formed; in that way, another piece of coaxial circular or annual partition made of an non-magnetic material in appropriate thickness is bonded to the outer side of the upper pole plate of the second set of dual magnetic gap, dual coil, and outer magnet driver unit 02, and the other side of the circular or annular partition is fixed by bonding to the upper pole plate of a third set of dual magnetic gap, dual coil, and outer magnet driver unit 02 of the transducer; the first set, second set, third set, . . . , of dual magnetic gap, dual coil, and outer magnet driver unit 02 take the same central axis Y-Y as their vertical symmetry axis, and have the same coil framework, the same frame and bracket, the same tubular magnetic yoke, the circular or annular partitions in the same physical dimensions, four, six, or more annular magnetic gaps and four, six, or more coils matching the annular magnetic gaps; thus, a super-high sensitivity, high fidelity, and outer magnet multi-driver transducer having one or more pairs of mutually-repelling magnets, symmetrical magnetic circuits, and symmetrical coil circuits is constituted.

In the multi-driver transducer having symmetrical magnetic circuits and symmetrical coil circuits, the thickness of the coaxial circular or annular partition made of a non-magnetic material and fixed by bonding to the outer side of the lower pole plate of the two sets of dual magnetic gap, dual coil and inner magnet driver unit 01 or dual magnetic gap, dual coil, and outer magnet driver unit 02 should ensure that the two sets of dual magnetic gap, dual coil, and inner magnet driver unit 01 or dual magnetic gap, dual coil, and outer magnet driver unit 02 having mutually-repelling magnetic features still have two sets of magnetic circuits with geometric shape and magnetic features in bilateral symmetry and vertical symmetry and two sets of coil circuits with geometric shape and electrical features in bilateral symmetry and vertical symmetry.

In the multi-driver transducer having symmetrical magnetic circuits and symmetrical coil circuits, the tubular magnetic yoke can be bound with two or more sections of tubular magnetic yokes that are in the same axial height, coaxial and isodiametric with each other in relation to the vertical symmetry axis Y-Y, and one or more coaxial circular or annular partitions made of an non-magnetic material in appropriate thickness into an integral assembly.

In the multi-driver transducer having symmetrical magnetic circuits and symmetrical coil circuits, the air venting through-holes arranged in the annular groove of the bracket, which are configured to vent the heat generated by the magnetic circuits and coil circuits and reduce the air damping of the vibrating system of the transducer, and each of which should have the same projected area that is as large as possible, provided that the physical dimensions and structural strength of the bracket permit; the circle center or center line of the air venting through-holes is arranged on the circumference of the projected circle of the coil framework or the coaxial and isodiametric coils, and the coil circuits are always kept in the bilateral symmetry state when the vibrating system of the transducer vibrates up and down.

In the multi-driver transducer having symmetrical magnetic circuits and symmetrical coil circuits, a flange is arranged on the bottom of the bracket, one end of a frame made of a non-magnetic material is fixed by coupling to the flange, the other end of the frame is arranged with a flange that has a diameter larger than the diameter of the damper, an inwardly protruding platform is arranged at the central axis of the larger flange, an inwardly protruding column is arranged at the central axis of the inwardly protruding platform, the tubular magnetic yoke is flush-mounted or fixed by bonding to the inwardly protruding column of the flange; thus, a coaxial and isodiametric annular magnetic gap is formed; a damper is fixed by bonding to the annular platform face of the frame, and both the frame and the flange have evenly distributed heat and air venting spaces.

The present invention has the following beneficial effects:

1. Excellent and efficient energy saving feature: utilizing the principle of the multi-driver transducer having symmetrical magnetic circuits and symmetrical coil circuits in the present invention, great axial thrust can be provided, while the back electromotive force of the transducer is eliminated, so that a loudspeaker (especially a woofer or sub-woofer) can obtain a value of Sound Pressure Level (SPL) at a super-high efficiency.
2. Utilizing the principle of symmetrical magnetic circuits and symmetrical coil circuits in the present invention, the inductance and back electromotive force in the symmetrical coil circuits of a loudspeaker can be eliminated, and thereby the total harmonic distortion (THD) of a woofer or sub-woofer can be improved unprecedentedly. For example, in a 5.25" four-driver woofer produced under the principle disclosed in the present invention, when the resonant frequency F0 is 50 Hz, the SPL is larger than or equal to 90.2 dB/1 w/1 m, and the THD+N is larger than or equal to smaller than or equal to 1.8%.
3. Make a breakthrough to enable a 2.1-channel or 4.1-channel sound system to meet the Hi-Fi sound standard.
4. The transducer has transparent front and rear magnetic circuit cavities and excellent heat venting system; thus, the transient response features and power compression phenomenon of the loudspeaker can be improved significantly.
5. With the great axial thrust provided under the multi-driver principle, a great breakthrough can be made in the functional performance of a moving coil type electromechanical transducer.

The mapping relation between the major elements and reference signs in the present invention are listed as follows:

103A-603A: upper pole plate
103B-603B: lower pole plate
101-601: frame
1013-6013: frame and bracket binding bolt
1871-2871: open-end tube
181-681: bracket
133-633: mating face of recessed part
102-602: permanent magnet
106-606: vibrating diaphragm/planar sounding board
199-699: protruding edge
141-641: damper
105-605: dust cup
107-607: coil framework
109-609 (A/B): coil
110-610 (A/B): annular magnetic gap
163-663: annular groove
111-611: inwardly protruding platform face
112-612: inwardly protruding column
11200-61200 annular mating face of inwardly protruding column
113-613: tubular magnetic yoke
1118-6118: inwardly protruding platform of bracket
1810-6810: horizontal positioning face of tubular thin wall of bracket
1820-6820: vertical positioning face of tubular thin wall of bracket
182-682: air venting through-hole
1020, 2020: circular or annular partition made of a non-magnetic material
1021, 2021: circular or annular partition made of a non-magnetic material
1710-6710: fastener made of a non-magnetic material
172-672: pressing plate made of a non-magnetic material
175-675: nut made of a non-magnetic material
170-670: recessed axial center hole

DETAILED DESCRIPTION

Figure 1:
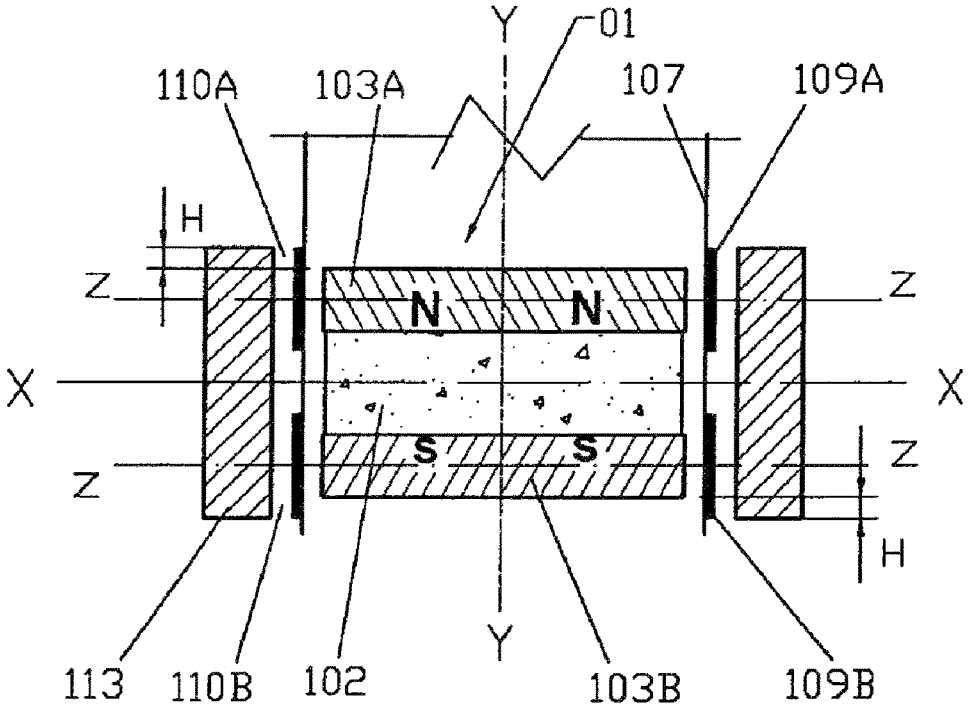
FIG. 1 shows a longitudinal sectional plan of an embodiment 1 in the prior art and an improved solution of Embodiment 1.

FIG. 1 shows a longitudinal sectional plan of Embodiment 1 in the prior art and an improved solution of Embodiment 1.

Figure 6:
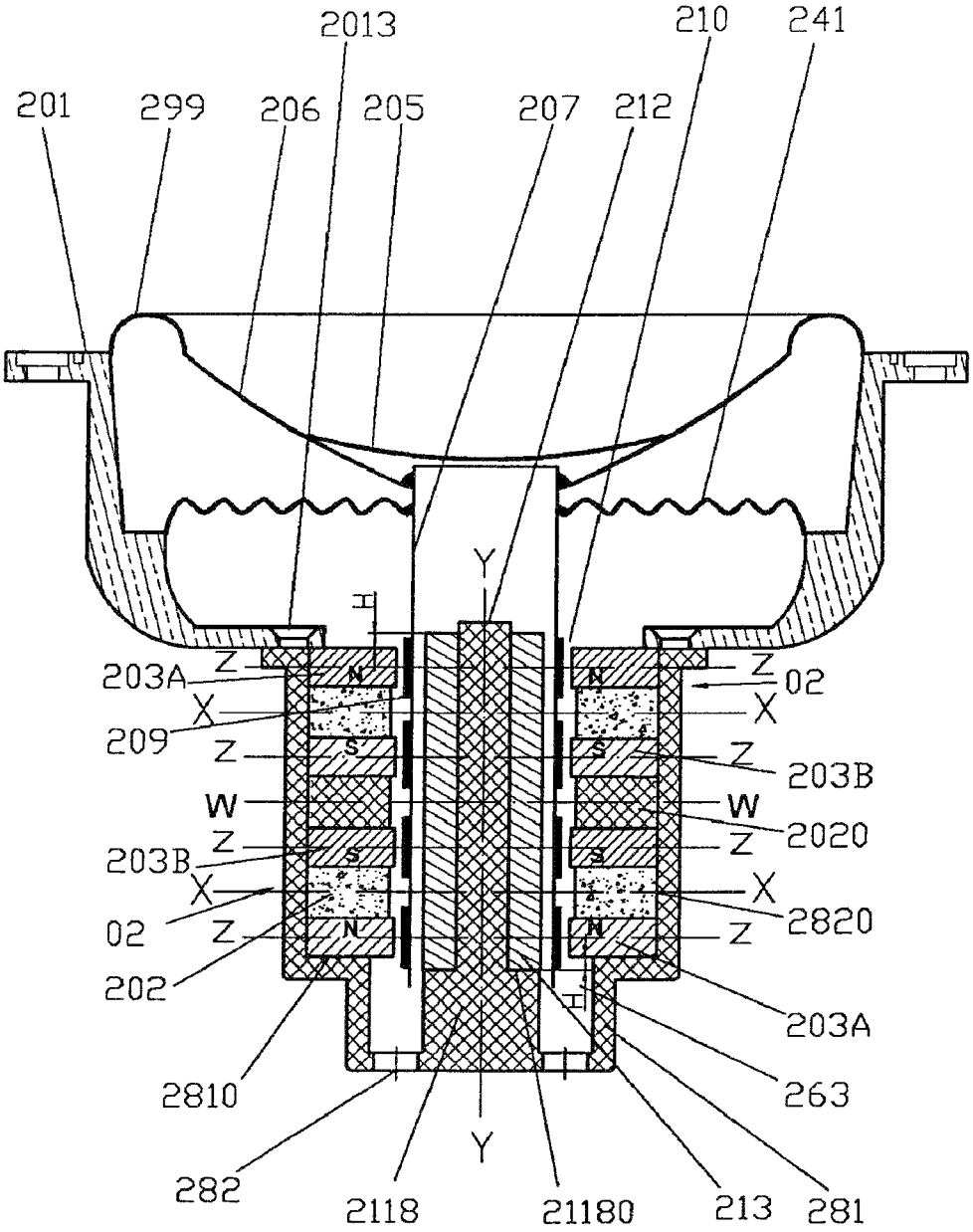
FIG. 6 shows a longitudinal sectional plan of Embodiment 1 of the outer magnet multi-driver transducer disclosed in the present invention.

This figure is a partial sectional view of a magnetic core (including coils 109 and a coil framework 107) in the embodiment shown of FIG. 6 disclosed in the published PCT/CN2008/072668 of the inventor. Upper pole plate 103A and lower pole plate 103B are two coaxially mounted circular plates that have the same thickness and the same projected area, a Nd—Fe—B magnet 102 matching the upper pole plate 103A and lower pole plate 103B is bonded between the upper pole plate 103A and the lower pole plate 103B, . . . , and a tubular magnetic yoke 113 is fitted over the central axis part of the magnetic core, . . . ; here, two coaxial isodiametric annular magnetic gaps 110A and 110B are formed between the inner circumferential face of the element 113 and the vertical circumferential face of the elements 103A and 103B, a coil framework 107 and coaxially mounted coils 109A and 109B are inserted into the annular magnetic gaps, and the coil 109A is in clockwise winding direction, while the coil 109B is in counter-clockwise winding direction (or vice versa). The coil 109A and coil 109B have the same cross-sectional area of electromagnetic wire, the same number of coil turns, the same coiling width, the same coil resistance, the same absolute value of coil inductance, and the same winding tension, and the two coils are connected in series into one coil, as shown in FIG. 12 in PCT/CN2008/072668; thus, two sets of magnetic circuits with geometric shape and magnetic features in bilateral symmetry and vertical symmetry and coil circuits with geometric shape and electrical features in bilateral symmetry and vertical symmetry are formed, with the bisector axis Z-Z at half axial height of the upper pole plate 103A, lower pole plate 103B and coiling diameter as a horizontal symmetry axis, the bisector axis X-X at half axial height of the permanent magnet 102 as a horizontal symmetry axis, and the axis Y-Y of the element 103A, element 102 and element 103B as a vertical symmetry axis. Thus, in this embodiment, the absolute value of inductance in the two coils 109A and 109B and the back electromotive force obtained via induction in the two coils during the reciprocating movement of the two coils offset each other due to the phase angle of 180 degree. This embodiment is a set of dual magnetic gap, dual coil, and inner magnet transducer driver unit 01 with resistive load features or near-resistive load features, super-high sensitivity, and high-fidelity quality. Please see FIG. 6, FIGS. 9-12, FIG. 20, and FIG. 21 in the published PCT/CN2008/072668 and the specification in CN200510091936.0 and US2005/0099255A1 for more details.

Apparently, to enable the transducer to obtain the symmetrical magnetic circuit and symmetrical coil circuit features as described in the prior art (e.g., PCT/CN2008/072668) in the dynamic working process, a novel improved solution is put forward in the present invention on the basis of the prior solution: with the bisector axis Z-Z at half axial height of the upper pole plate 103A, lower pole plate 103B and coiling width of coils 109A and 109B as a horizontal symmetry axis, this embodiment of the present invention obtains an optimal feature, i.e., the magnetic circuits are in vertical bilateral and symmetry and the coil circuits are in vertical and bilateral symmetry.

Figure 2:
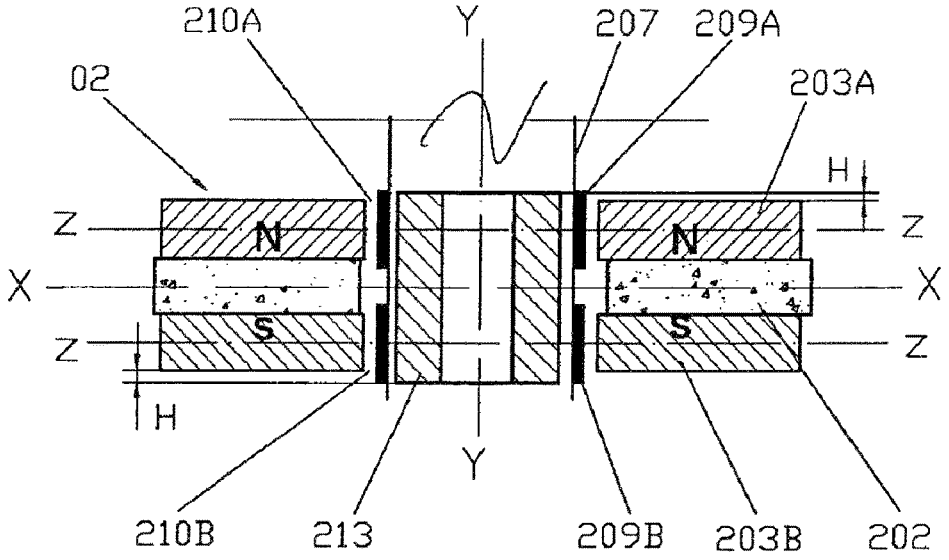
FIG. 2 shows a longitudinal sectional plan of an embodiment 2 in the prior art and an improved solution of Embodiment 2.

FIG. 2 shows a longitudinal sectional plan of Embodiment 2 in the prior art and an improved solution of Embodiment 2.

Figure 5:
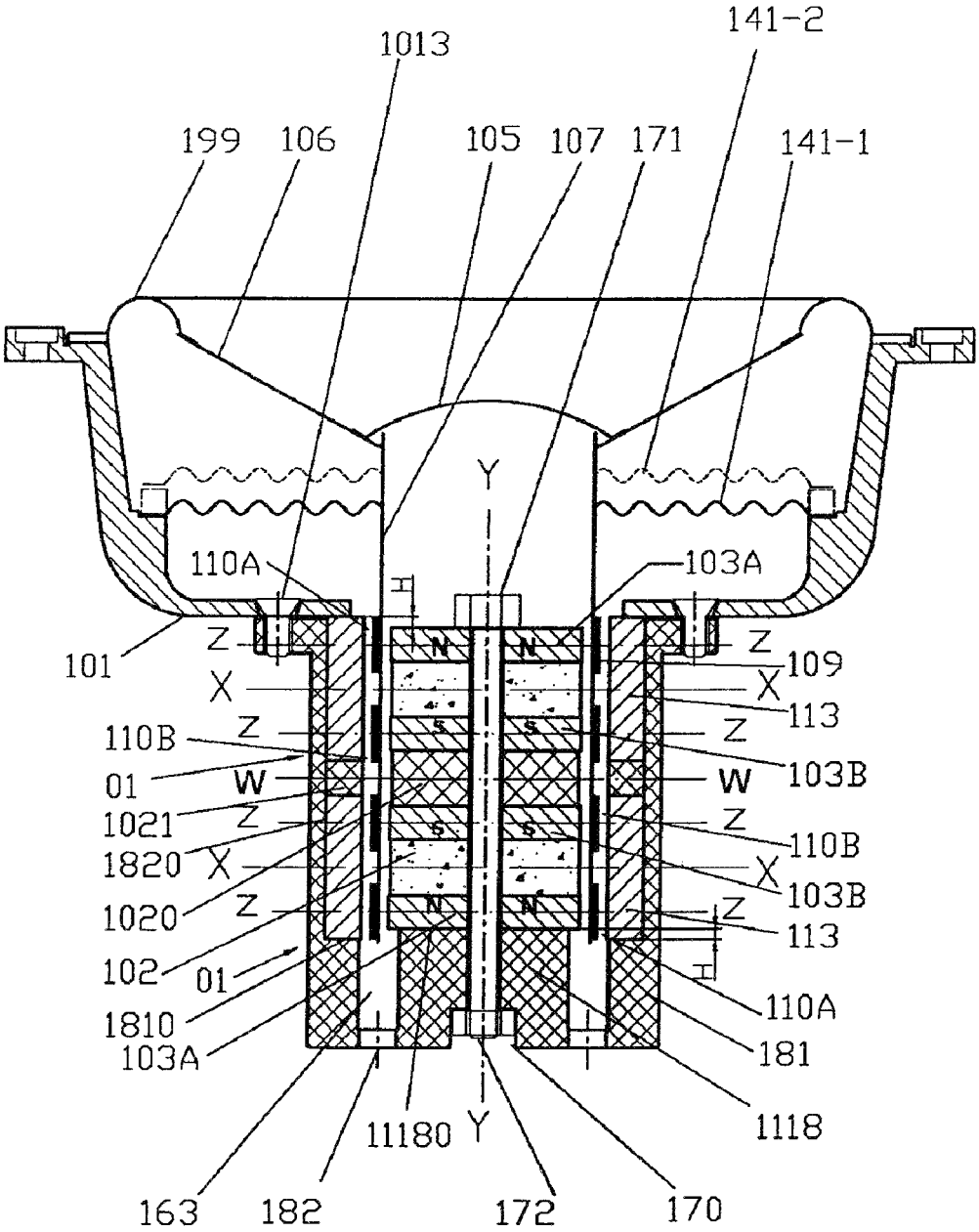
FIG. 5 shows a longitudinal sectional plan of Embodiment 3 of the inner magnet multi-driver transducer disclosed in the present invention.

This figure is a partial sectional view of a magnetic core (including coils 209 and a coil framework 207) in the embodiment shown in FIG. 5 disclosed in the published PCT/CN2008/072668 of the inventor. Upper pole plate 203A and lower pole plate 203B are two coaxially mounted annular plates that have the same thickness and the same projected area, a Nd—Fe—B magnet 202 matching the upper pole plate 203A and lower pole plate 203B is bonded between the upper pole plate 203A and the lower pole plate 203B, . . . , and a tubular magnetic yoke 213 is fitted over the central axis part of the magnetic core; here, two coaxial isodiametric annular magnetic gaps 210A and 210B are formed between the outer circumferential face of the element 213 and the vertical circumferential face of the elements 203A and 203B, a coil framework 207 and coaxially mounted coils 209A and 209B are inserted into the annular magnetic gaps, and the coil 209A is in clockwise winding direction, while the coil 209B is in counter-clockwise winding direction (or vice versa). The coil 209A and coil 209B have the same cross-sectional area of electromagnetic wire, the same number of coil turns, the same coiling width, the same coil resistance, the same absolute value of coil inductance, and the same tension when winding, and the two coils are connected in series into one coil, as shown in FIG. 12 in PCT/CN2008/072668; thus, two sets of magnetic circuits with geometric shape and magnetic features in vertical and bilateral symmetry and coil circuits with geometric shape and electrical features in vertical and bilateral symmetry are formed, with the bisector axis Z-Z at half axial height of the upper pole plate 203A, lower pole plate 203B, and coiling width as a horizontal symmetry axis, the bisector axis X-X at half axial height of the permanent magnet 102 as a horizontal symmetry axis, and the axis Y-Y of the element 203A, element 202, and element 203B as a vertical symmetry axis. Thus, in this embodiment, the absolute value of inductance in the two coils 209A and 209B and the back electromotive force obtained via induction in the two coils during the reciprocating movement of the two coils offset each other due to the phase angle of 180 degree. This embodiment is a set of dual magnetic gap, dual coil, and outer magnet transducer driver unit 02 with resistive load features or near-resistive load features, super-high sensitivity, and high-fidelity quality. See FIG. 5, FIGS. 9-12, FIG. 20, and FIG. 21 in PCT/CN2008/072668 and the specification in CN200610020317.7 for more details.

Apparently, to enable the transducer to obtain the symmetrical magnetic circuit and symmetrical coil circuit features as described in the prior art (e.g., PCT/CN2008/072668) in the dynamic working process, a novel improved solution is put forward in the present invention on the basis of the prior solution: with the bisector axis Z-Z at half axial height of the upper pole plate 103A, lower pole plate 103B and coiling width of coils 109A and 109B as a horizontal symmetry axis, this embodiment of the present invention obtains an optimal feature, i.e., the magnetic circuits are in vertical bilateral and symmetry and the coil circuits are in vertical and bilateral symmetry.

Figure 3:
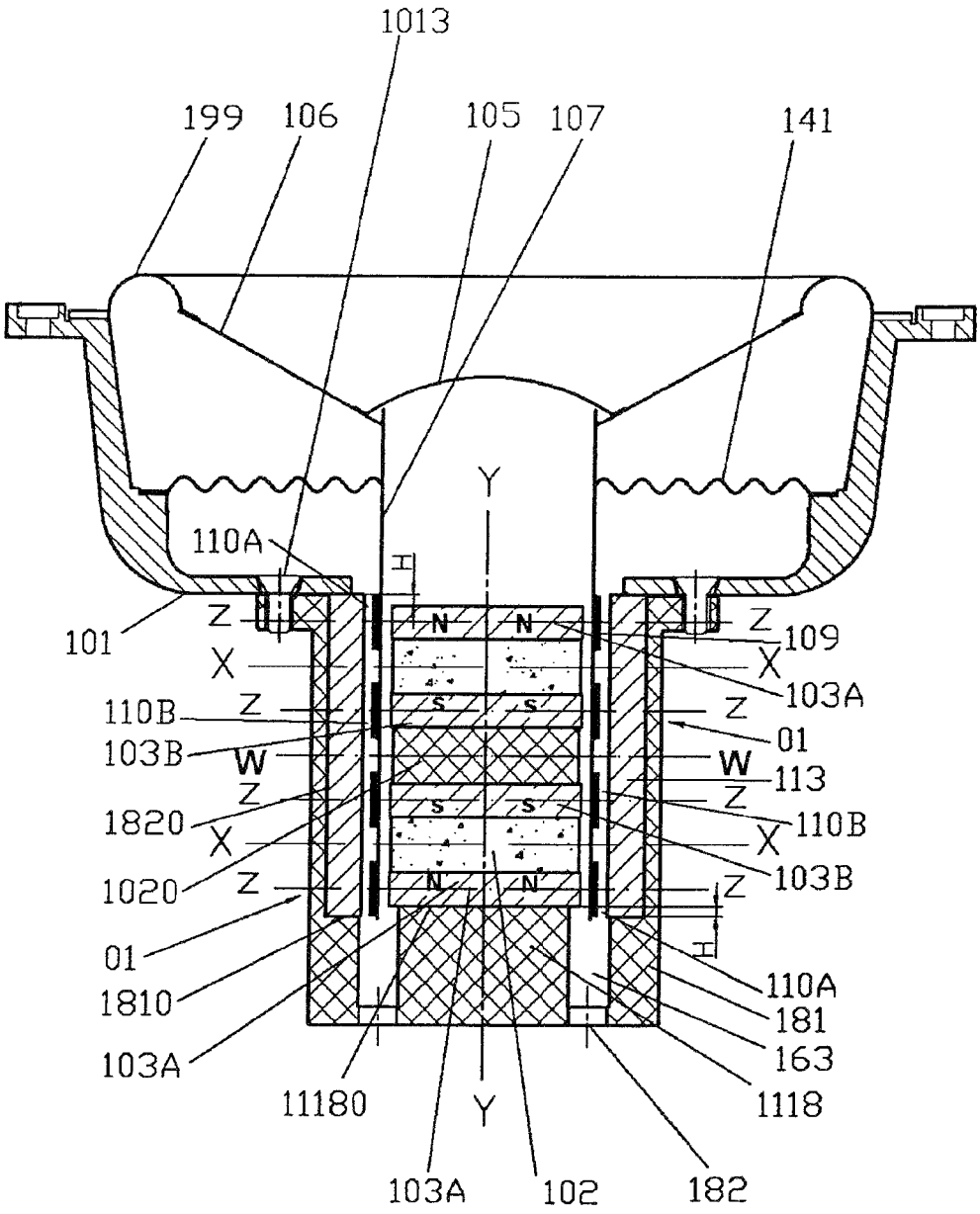
FIG. 3 shows a longitudinal sectional plan of Embodiment 1 of the inner magnet multi-driver transducer disclosed in the present invention.

FIG. 3 shows a longitudinal sectional plan of Embodiment 1 of the inner magnet multi-driver transducer disclosed in the present invention.

This is an embodiment of an inner magnetic four-driver loudspeaker having symmetrical magnetic circuits and symmetrical coil circuits. Upper pole plate 103A and lower pole plate 103B are coaxially mounted, have the same thickness and projected area, and match the permanent magnet 102; one or more uniform-thickness, uniformly distributed, and axially charged Nd—Fe-b magnets 102 bond the upper pole plate 103A and lower pole plate 103B into an integrated magnetic core. Thus, two identical sets of dual magnetic gap, dual coil, and inner magnet driver unit 01 are formed, and each set of dual magnetic gap, dual coil, and inner magnet transducer driver unit 01 have the same structure and working principle as the transducer driver unit described in the embodiment shown in FIG. 1. Hence these transducer driver unit will not be further detailed here.

The frame 101 is an aluminum alloy frame, with an axial hole in its bottom to fit with the magnetic core and coil formwork 107 of a loudspeaker. A bracket 181 made of aluminum alloy is arranged, with an inwardly protruding circular platform 1118 arranged at the central axis part, the circular platform has a smooth and regular vertical circumferential face, with an annular groove 163 arranged in the outer side of the vertical circumferential face, the annular groove 163 has two or more evenly distributed air venting through-holes 182 in its bottom, the outer side of the annular groove 163 constitutes an open-end tubular thin wall of the bracket 181, the inner circumferential face of the tubular thin wall is arranged with smooth and regular horizontal positioning face 1810 and vertical positioning face 1820 at a corresponding height in axial direction, and the tubular thin wall of the bracket 181 is arranged on its top with a flange extending outwards and matching the frame 101; the flange is arranged with several evenly distributed bolt holes in it, and binds the frame 101 with the bracket 181 into an integral assembly by means of bolts 1013.

Adhesive is applied on the outer side of the lower pole plate 103B of the magnetic core of the first set of dual magnetic gap, dual coil, and inner magnet driver unit 01 that is assembled by bonding, and the outer side of the lower pole plate 103B is bonded to a circular aluminum alloy partition 1020 made of an non-magnetic material in appropriate thickness; then, adhesive is applied to the other side of the circular partition 1020, and that side is bonded to the lower pole plate 103B of the magnetic core of a second set of dual magnetic gap, dual coil, and inner magnet driver unit 01 that is assembled by bonding, utilizing a fixture; the polarities of the magnetic cores of the two sets of dual magnetic gap, dual coil, and inner magnet driver unit 01 are shown in FIG. 3; thus, a coaxial and isodiametric magnetic core of a dual magnetic gap, dual coil, and inner magnet four-driver loudspeaker having a pair of mutually-repelling magnets is formed. Adhesive is applied to the outer horizontal face 1180 of the inwardly protruding circular platform 1118, and the magnetic core is fixed to the identical axis Y-Y of the internally protruding circular platform 1118, frame 101, and bracket 181 (i.e., the vertical symmetry axis of the transducer).

A tubular magnetic yoke 113 coaxially mounted with the magnetic core is flush-mounted or fixed by bonding to the inner circumferential face of the tubular thin wall of the bracket 181 from top to bottom, and is positioned via bonding or fixed via fitting by the vertical positioning face 1820 and horizontal positioning face 1810, the other end of the tubular magnetic yoke 113 is embedded in the circular axial hole in the bottom of the frame 101 and is fixed by coupling or bonding to the frame 101, the two outer horizontal end faces of the tubular magnetic yoke 113 go beyond the outer polar face of the two upper pole plates 103A by 0.5-20 mm of value H respectively in axial height, the central axis of the inner circumferential face of tubular magnetic yoke 113 is vertical symmetry in relative to the central axis Y-Y of the upper pole plate 103A, permanent magnet 102, and lower pole plate 103B, four coaxial isodiametric annular magnetic gaps 110 are formed between the vertical circumferential face of the two upper pole plates 103A and the two lower pole plates 103B and the inner circumferential face of the tubular magnetic yoke 113, four coaxial and isodiametric coils 109 are inserted in the annular magnetic gaps 110, and the winding directions of the two coils 109 and the directions of current flowing through the coils in each set of dual magnetic gap, dual coil, and inner magnet driver unit 01 are governed, so that the coil 109A and coil 109B generate electromotive forces F in the same direction at a working moment.

Thus, two sets of magnetic circuits with geometric shape and magnetic features in bilateral symmetry and vertical symmetry and two sets of coil circuits with geometric shape and electrical features in bilateral symmetry and vertical symmetry, with a pair of mutually-repelling magnets, are formed, with the bisector axis W-W at half axial height of the circular partition 1020 as a horizontal symmetry axis and the central axis Y-Y of the upper pole plate 103A, permanent magnet 102, and lower pole plate 103B as a vertical symmetry axis. As described in the embodiment shown in FIG.

1, in each set of symmetrical coil circuits, the two coils 109A and 109B have winding directions opposite to each other after they are connected in series, and the two coils have the same cross-sectional area of electromagnetic wire, the same number of coil turns, the same coiling width, the same coil resistance, the same absolute value of coil inductance, and the same tension when winding; finally, the two sets of symmetrical and serially connected coil circuits are connected in parallel (not shown in this embodiment), and thus the two sets of dual magnetic gap, dual coil, and inner magnet driver unit 01 constitute an inner magnet four-driver loudspeaker, . . . , that have a pair of mutually-repelling magnet and resistive load features or near-resistive load features, with the back electromotive forces in each set of serially connected coil circuits offsetting each other; in that way, another coaxial circular or annular partition 1020 made of a non-magnetic material in appropriate thickness is bonded to the outer side of the upper pole plate 103A of the second set of dual magnetic gap, dual coil, and inner magnet driver unit 01, and the other side of the circular or annular partition 1020 is bonded to the outer side of the upper pole plate 103A of a third set of dual magnetic gap and dual coil driver unit 01 of the transducer; thus, three or more sets of dual magnetic gap, dual coil, and inner magnet driver unit 01 having mutually-repelling magnets are formed, and the first set, second set, third set, . . . , of dual magnetic gap, dual coil, and inner magnet driver unit 01 take the same central axis Y-Y as a vertical symmetry axis, have the same coil framework, the same frame and bracket, the same tubular magnetic yoke, four, six or more coaxial isodiametric annular magnetic gaps 110 and four, six or more coaxial and isodiametric coils 109 matching the four, six or more coaxial isodiametric annular magnetic gaps 110; thus, an inner magnet multi-driver transducer having one or more pairs of mutually-repelling magnets, symmetrical magnetic circuits, and symmetrical coil circuits are formed.

It should be noted particularly that the thickness of the circular or annular partition 1020 made of a non-magnetic material is closely related with the thickness of the upper pole plate 103A and the lower pole plate 103B, and the thickness and magnetic energy product of the permanent magnet 102. The appropriate thickness described above refers to a specific thickness, and under this specific thickness, the influence on the vertical symmetry feature of the two sets of symmetrical magnetic circuits and the two sets of symmetrical coil circuits in each set of dual magnetic gap, dual coil driver unit 01 in this embodiment is negligible, and within allowable tolerance.

Furthermore, a ring of air venting through-holes 182 configured to vent the heat generated by the magnetic circuits and coil circuits and decrease the air damping in the vibrating system of the transducer are arranged in the annular groove of the bracket 181, and each of these air venting through-holes 182 has the same projected area that is as large as possible, provided that the physical dimensions and structural strength of the bracket 181 permit. To ensure that the symmetrical coils can be kept balanced dynamically during the up-down piston motion of the transducer, all air venting through-holes arranged in an annular array in the present invention have a circle center or center line arranged on the circumference of the projected circle of the coil framework 107 or coaxial and isodiametric coils, so that the coil circuits still remain in a required bilateral symmetry state when the vibrating system of the transducer vibrates up and down.

Figure 4:
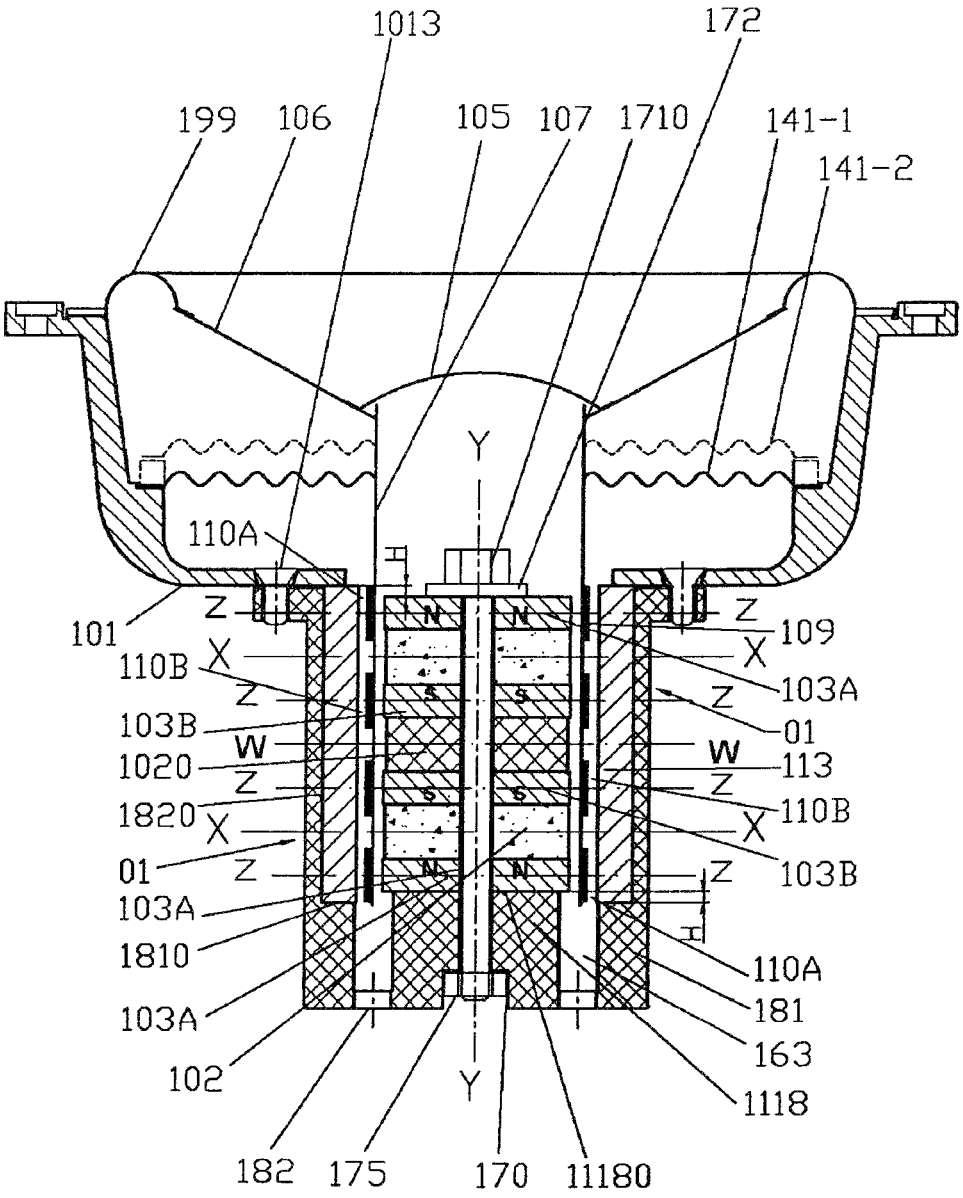
FIG. 4 shows a longitudinal sectional plan of Embodiment 2 of the inner magnet multi-driver transducer disclosed in the present invention.

FIG. 4 shows a longitudinal sectional plan of Embodiment 2 of the inner magnet multi-driver transducer disclosed in the present invention.

This is an improved solution based on the embodiment shown in FIG. 3, and is applicable to a middle-diameter or large-diameter inner magnet multi-driver loudspeaker. In this embodiment, the upper pole plates 103A and lower pole plates 103B are four circular pole plates, and the permanent magnet 102 has an axial hole that matches the upper pole plates 103A and lower pole plates 103B. A through-hole or bolt though-hole is arranged at the central axis of the inwardly protruding platform 1118 of the bracket. When the two sets of dual magnetic gap, dual coil, and inner magnet driver unit 01 shown in FIG. 1 are assembled, a fastener 1710 made of a non-magnetic material (e.g., a 1Cr18Ni9Ti stainless steel bolt) is inserted from top to bottom through all mating axial holes of a washer 172 made of a non-magnetic material, the upper pole plate 103A, the permanent magnet 102, the lower pole plate 103B, and the annular partition 1020 made of a non-magnetic material, and, with the aid of a non-magnetic nut 175 embedded in a recessed axial hole 170 in the bottom of the bracket 181, magnetic cores of the inner magnet driver unit 01 having one or more pairs of mutually-repelling magnets in this embodiment can be firmly bound with the bracket into an integral assembly by adhesive and the fastener.

As a variant of this embodiment, a bolt hole 1751 can be arranged at the central axis of the inwardly protruding platform 1118 of the bracket 181, and the magnetic core can be bound with the bracket into an integral assembly with a non-magnetic fastening bolt 1710.

For several other variants of this embodiment, please see FIGS. 3-5 and the description in the awarded Chinese patent CN200510091936.0 of the inventor.

In view that a medium-diameter or large-diameter inner magnet multi-driver loudspeaker usually has four or six drivers, its coil framework is usually very long. To avoid a coil chafing phenomenon incurred by radial deflection of the tail end of the coil framework when the coil framework moves in axial piston motion, a dual damper technical solution, in which two dampers are mounted at different heights in the axial direction, is employed in this embodiment. As shown in FIG. 4, dampers 141-1 and 141-2 are mounted at different heights on the coil framework 107. The larger the spacing between the two dampers is, the higher the controlling force against radial deflection of the tail end (near the annular groove 163) of the coil framework 107 is, and the lower the probability that a voice coil chafing phenomenon occurs in the loudspeaker is.

In other aspects, the structure and working principle of this embodiment are identical to those of the embodiment shown in FIG. 3, and will not be further detailed here.

FIG. 5 shows a longitudinal sectional plan of Embodiment 3 of the inner magnet multi-driver transducer disclosed in the present invention.

This is a variant of Embodiment 2 shown in FIG. 4: one tubular magnetic yoke 113 is changed to two separate tubular magnetic yokes 113 that are coaxial with each other and in the same height. In addition, an annular partition 1021 matching the two separate tubular magnetic yokes 113 made of a non-magnetic material is added to bond the two tubular magnetic yokes 113 into an integral assembly, . . . . In other aspects, the structure and working principle of this embodiment are identical to those of the embodiment shown in FIG. 4, and will not be further detailed here.

FIG. 6 shows a longitudinal sectional plan of Embodiment 1 of the outer magnet multi-driver transducer disclosed in the present invention.

This is an embodiment of an outer magnet four-driver loudspeaker having symmetrical magnetic circuits and symmetrical coil circuits. Upper pole plate 203A and lower pole plate 203B are two coaxially mounted annular pole plates, have the same thickness and the same projected area, and match the Nd—Fe—B permanent magnet 202; one or more uniform-thickness, uniformly distributed, and axially charged Nd—Fe-b magnets 202 bond the upper pole plate 203A and lower pole plate 203B into an integrated magnetic core. Thus, two identical sets of dual magnetic gap, dual coil, and outer magnet driver unit 02 are formed, and each set of dual magnetic gap, dual coil, and outer magnet transducer driver unit 02 have the same structure and working principle as the transducer driver unit described in the embodiment shown in FIG. 2. Hence, these transducer driver units will not be further detailed here.

The frame 201 is an aluminum alloy frame, with an axial hole in its bottom to fit with the magnetic core and coil formwork 207 of a loudspeaker. A bracket 281 made of aluminum alloy is arranged, with an inwardly protruding circular platform 2118 arranged at the central axis of the bracket 281, an inwardly protruding column 212 is arranged at the central axis of the circular platform, with an inwardly protruding platform face 211 arranged at the outer side of the base of the inwardly protruding column 212 and a smooth and regular vertical circumferential face arranged at the outer side, an annular groove 263 is arranged in the outer side of the vertical circumferential face, and the annular groove 263 has two or more evenly distributed air venting through-holes 282 in its bottom, the outer side of the annular groove 263 constitutes an open-end tubular thin wall of the bracket 281, the inner circumferential face of the tubular thin wall is arranged with smooth and regular horizontal positioning face 2810 and vertical positioning face 2820 at a corresponding height in axial direction, and the tubular thin wall of the bracket 281 is arranged on its top with a flange extending outwards and matching the frame 201; the flange is arranged with several evenly distributed bolt holes in it, and binds the frame 201 with the bracket 281 into an integral assembly by means of bolts 2013.

Adhesive is applied on the outer side of the lower pole plate 203B of the magnetic core of the first set of dual magnetic gap, dual coil, and outer magnet driver unit 02 that is assembled by bonding, and the lower pole plate 203B is bonded to a circular aluminum alloy partition 2020 made of an non-magnetic material in appropriate thickness; then, adhesive is applied to the other side of the circular partition 2020, and the circular partition 2020 is bonded to the lower pole plate 203B of the magnetic core of a second set of dual magnetic gap, dual coil, and outer magnet driver unit 02 that is assembled by bonding, utilizing a fixture; the polarities of the magnetic cores of the two sets of dual magnetic gap, dual coil, and outer magnet driver unit 02 are shown in FIG. 6; thus, a coaxial and isodiametric magnetic core of a dual magnetic gap, dual coil, and outer magnet four-driver loudspeaker having a pair of mutually-repelling magnets is formed.

Adhesive is applied to the horizontal positioning face 2810 and vertical positioning face 2820 of the open-end tubular thin-wall of the bracket 281, the magnetic core is embedded from top to bottom into the open-end tubular thin wall of the bracket 281 and fix it by bonding, while keeping the inwardly protruding circular platform 2118, inwardly protruding column 212, frame 201 and bracket 281 are in the same vertical axis Y-Y.

A tubular magnetic yoke 213 coaxially mounted with the magnetic core is flush mounted or fixed by bonding to the circumference of the inwardly protruding column 212 of the 281 from top to bottom, and is positioned via bonding or fixed via fitting by the inwardly protruding platform face 211. The two outer horizontal end faces of the tubular magnetic yoke 213 go beyond the outer polar faces of the two upper pole plates 203A by 0.5-20 mm of value H in axial height, the inner circumferential face of the tubular magnetic yoke 213 is vertical symmetry in relative to the central axis Y-Y of the upper pole plate 203A, permanent magnet 202, and lower pole plate 203B, four coaxial isodiametric annular magnetic gaps 210 are formed between the vertical circumferential face of the two upper pole plates 203A and the two lower pole plates 203B and the outer circumferential face of the tubular magnetic yoke 213, and four coaxial and isodiametric coils 209 are inserted into the annular magnetic gaps 210; the winding directions of the two coils 209 in each set of dual magnetic gap, dual coil, and outer magnet driver unit 02 and the directions of current flowing through the coils are governed, so that the coils 209 generate electromotive forces F in the same direction at a working moment; thus, two sets of magnetic circuits with geometric shape and magnetic features in bilateral symmetry and vertical symmetry and two sets of coil circuits with geometric shape and electrical features in bilateral symmetry and vertical symmetry, with a pair of mutually-repelling magnets, are formed, with the bisector axis W-W at half axial height of the circular partition 2020 as a horizontal symmetry axis and the central axis Y-Y of the upper pole plate 203A, permanent magnet 202, and lower pole plate 203B as a vertical symmetry axis. As described in the embodiment shown in FIG. 2, in each set of symmetrical coil circuits, the two coils 209 have winding directions opposite to each other after they are connected in series, and the two coils have the same cross-sectional area of electromagnetic wire, the same number of coil turns, the same coiling width, the same coil resistance, the same absolute value of coil inductance, and the same tension when winding; finally, the two sets of symmetrical and serially connected coil circuits are connected in parallel (not shown in this embodiment), and thus the two sets of dual magnetic gap, dual coil, and outer magnet driver unit 02 constitute an outer magnet four-driver loudspeaker that have a pair of mutually-repelling magnet and resistive load features or near-resistive load features, with the back electromotive forces in each set of serially connected coil circuits offsetting each other; in that way, another coaxial circular or annular partition 2020 made of a non-magnetic material in appropriate thickness is bonded to the outer side of the upper pole plate 203A of the second set of dual magnetic gap, dual coil driver unit 02, and the other side of the circular or annular partition 2020 is bonded to the outer side of the upper pole plate 203A of a third set of dual magnetic gap and dual coil driver unit 02 of the transducer; thus, three or more sets of dual magnetic gap, dual coil driver unit 02 having mutually-repelling magnets are formed, and the first set, second set, third set, . . . , of dual magnetic gap, dual coil driver unit 02 take the same central axis Y-Y as a vertical symmetry axis, have the same coil framework, the same frame and bracket, the same tubular magnetic yoke, four, six or more coaxial isodiametric annular magnetic gaps 210 and four, six or more matching coaxial and isodiametric coils 209 matching the four, six or more coaxial isodiametric annular magnetic gaps 210; thus, an outer magnet multi-driver transducer having one or more pairs of mutually-repelling magnets, symmetrical magnetic circuits, and symmetrical coil circuits are formed.

It should be noted particularly that the thickness of the circular or annular partition 2020 made of a non-magnetic material is closely related with the thickness of the upper pole plate 203A and of the lower pole plate 203B, and the thickness and magnetic energy product of the permanent magnet 202. The appropriate thickness described above refer to a specific thickness, and under this specific thickness, the influence on the vertical symmetry feature of the two sets of symmetrical magnetic circuits and the two sets of symmetrical coil circuits in each set of dual magnetic gap and dual coil driver unit 02 in this embodiment is negligible, and within allowable tolerance.

In other aspects, the structure and working principle of this embodiment are identical to those of the embodiment shown in FIG. 3, and will not be further detailed here.

Figure 7:
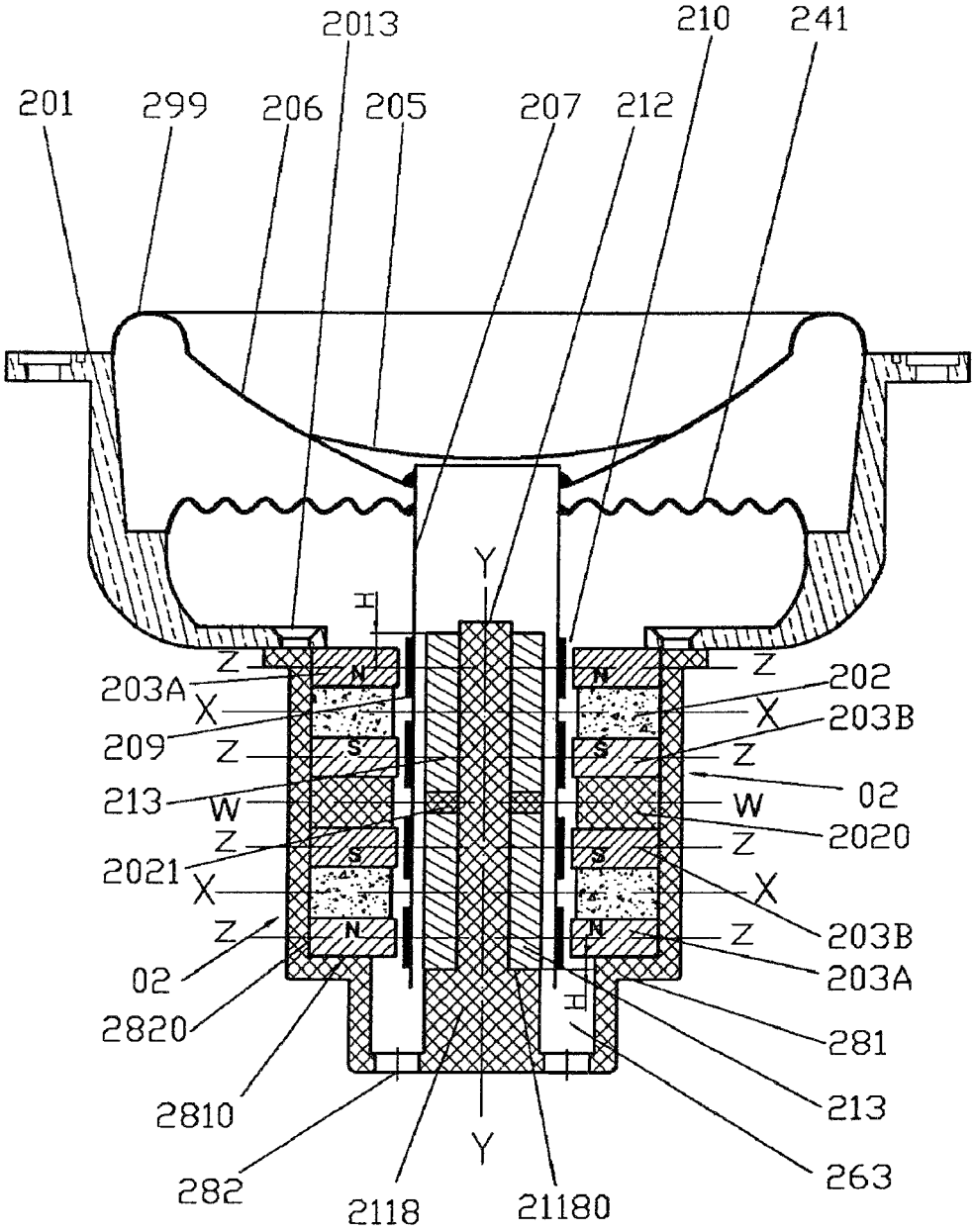
FIG. 7 shows a longitudinal sectional plan of Embodiment 2 of the outer magnet multi-driver transducer disclosed in the present invention.

FIG. 7 shows a longitudinal sectional plan of Embodiment 2 of the outer magnet multi-driver transducer disclosed in the present invention.

This is a variant of the Embodiment 2 shown in FIG. 6: one tubular magnetic yoke 213 is changed to two separate tubular magnetic yokes 213 that are coaxial with each other and in the same height. In addition, an annular partition 2021 matching the two separate tubular magnetic yokes 213 made of a non-magnetic material is added to bond the two tubular magnetic yokes 213 into an integral assembly, . . . . In other aspects, the structure and working principle of this embodiment are identical to those of the Embodiment 1 shown in FIG. 6, and will not be further detailed here.

Figure 8:
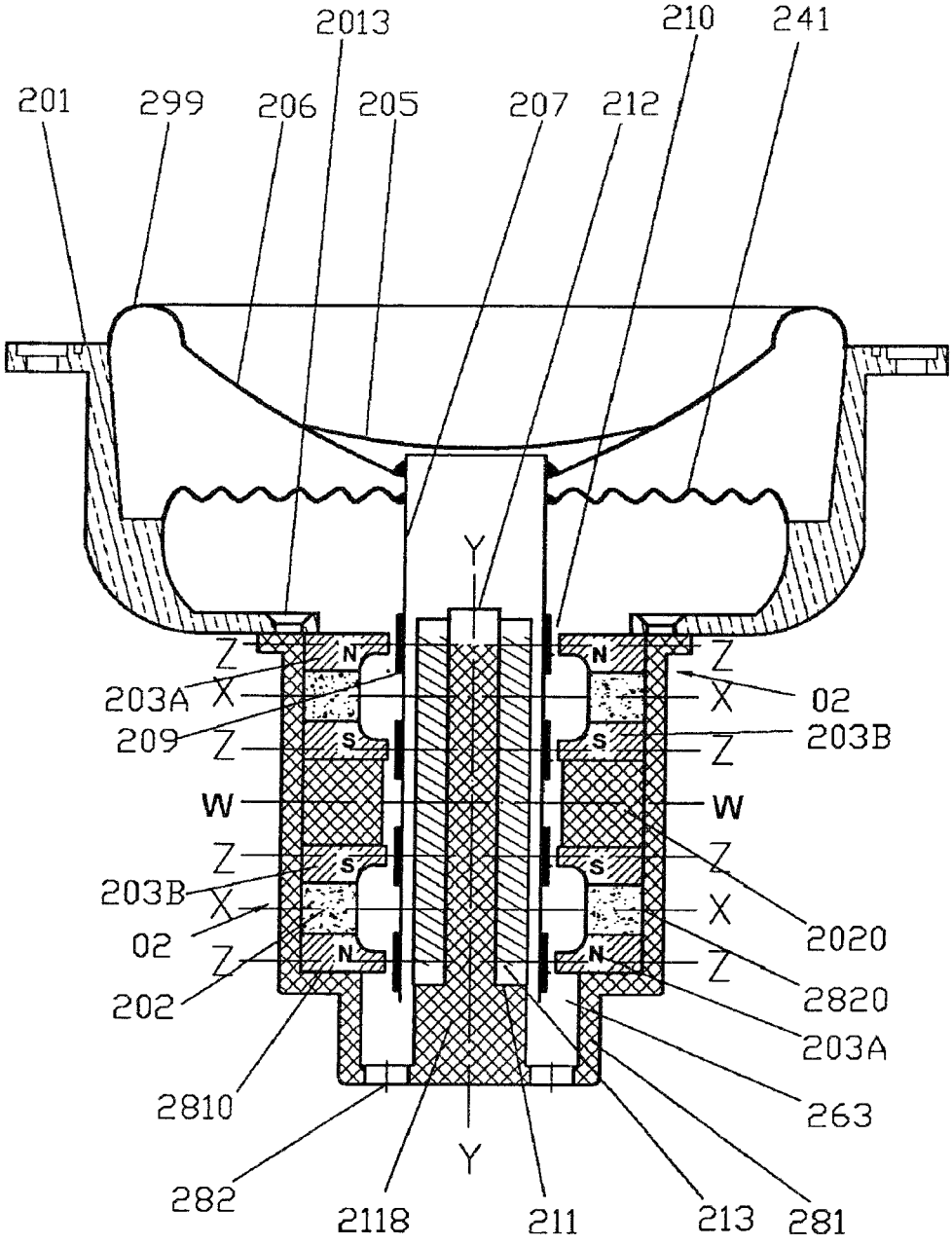
FIG. 8 shows a longitudinal sectional plan of Embodiment 3 of the outer magnet multi-driver transducer disclosed in the present invention.

FIG. 8 shows a longitudinal sectional plan of Embodiment 3 of the outer magnet multi-driver transducer disclosed in the present invention.

The pole plates 203A and 203B shown in the figure are two pole plates with axial holes different in diameter. Therefore, the Z-Z axial distance is much greater than that in the Embodiment 2 shown in FIG. 6. That is to say, this embodiment is especially suitable for use in the cases in which the linear stroke is very long. In other aspects, this embodiment is identical to description of the embodiment shown in FIG. 6.

Figure 9:
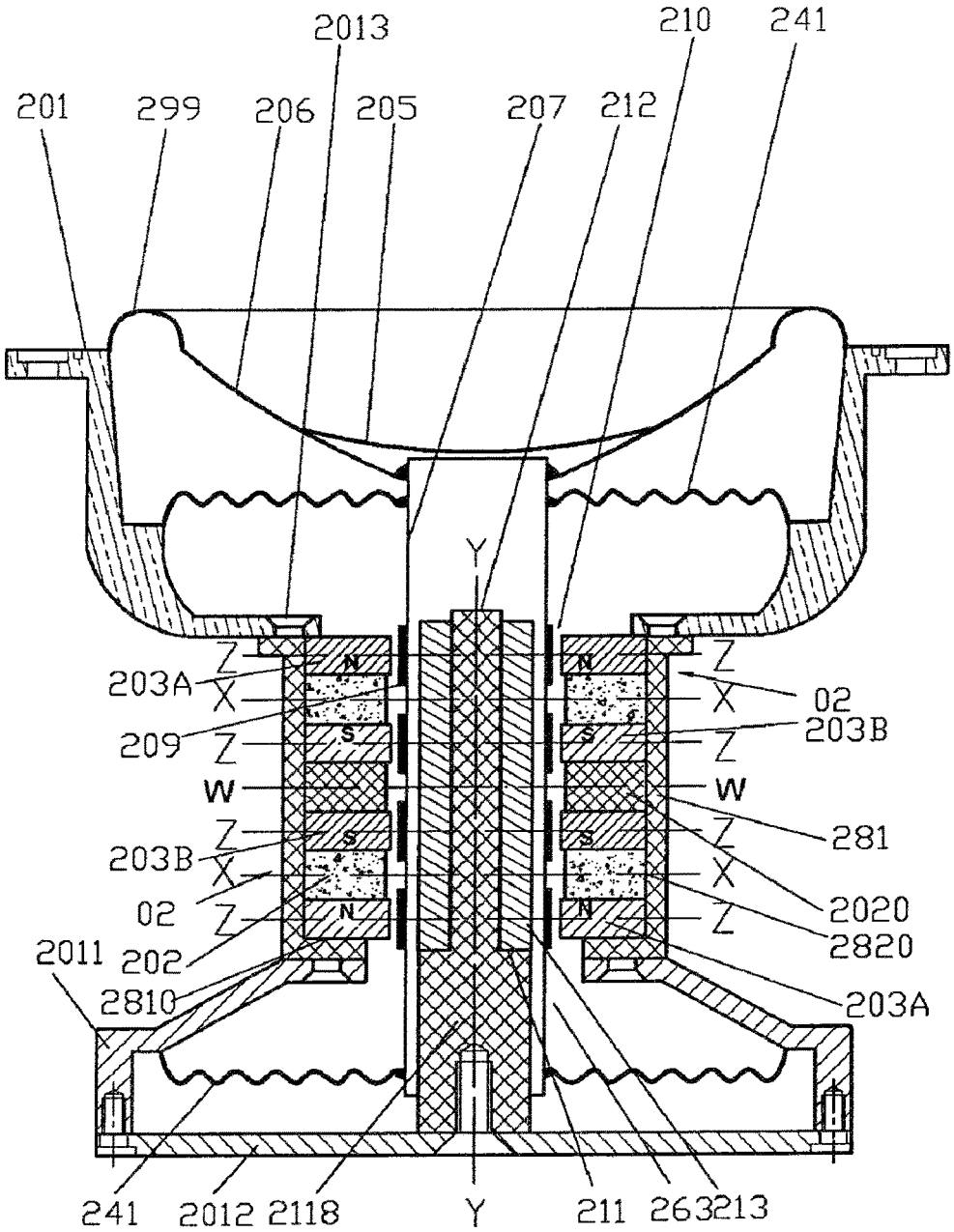
FIG. 9 shows a longitudinal sectional plan of Embodiment 4 of the outer magnet multi-driver transducer disclosed in the present invention.

FIG. 9 shows a longitudinal sectional plan of Embodiment 4 of the outer magnet multi-driver transducer disclosed in the present invention.

This is an embodiment with a varied bracket 281 and a varied second frame 2011. It is seen from the figure: two isodiametric dampers 241 are mounted in a mirrored manner, with the axis W-W as their horizontal symmetry axis. The bracket 281 has an axial center hole matching the coil framework 207 in its lower end, with a matching frame 2011 bound to it on its outer face. A circular plate 2012 made of a non-magnetic material with a flange is arranged on the outer face of the inverted frame 2011, an inwardly protruding column 2118 is arranged at the central axis part of the circular plate 2012; as shown in FIG. 6, four or more coaxial isodiametric annular magnetic gaps 210 are formed between the outer circumferential face of a tubular magnetic yoke 211 coaxially mounted in relation to the axis Y-Y and the vertical circumferential faces of the pole plates 203A and 203B, . . . ; thus, a dual-damper multi-driver solution with upper damper and lower damper, in which the radial deflection of the coil framework 207 can be controlled much better, is formed.

What is claimed is:

1. A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitute coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils, wherein:

a. the frame is a frame made of a non-magnetic material, or the frame and the bracket are integrated into an integral frame;

b. the magnetic circuit has coaxially installed upper pole plate and lower pole plate, and the pole plates have the same thickness and the same projected area and match a permanent magnet; the permanent magnet is one or more uniform-thickness, uniformly distributed, and axially charged permanent magnets which bind the upper pole plate and lower pole plate into an integrated magnetic core;

c. the bracket is a bracket made of a non-magnetic material, with an inwardly protruding circular platform arranged at its central axis part, the circular platform has a smooth and regular vertical circumferential face, with an annular groove arranged in the outer side of the vertical circumferential face, the annular groove has two or more evenly distributed air venting through-holes in its bottom, the outer side of the annular groove constitutes an open-end tubular thin wall of the bracket, a smooth and a regular horizontal positioning face and vertical positioning face are arranged on the inner circumferential face of the tubular thin wall at a corresponding height in axial direction or on its top, and the tubular thin wall of the bracket is arranged on its top with a flange extending outwards and coupled to the frame;

d. the upper pole plate, permanent magnet, and lower pole plate are fixed by bonding to the central axis part of the circular platform face of the bracket, a tubular magnetic yoke coaxially mounted with the upper pole plate, permanent magnet, and lower pole plate is flush-mounted or fixed by bonding to the inner circumferential face of the tubular thin wall of the bracket, and is positioned via bonding the vertical positioning face and horizontal positioning face or fixed via fitting by the vertical positioning face and horizontal positioning face, the other end of the tubular magnetic yoke is embedded in the circular axial hole in the bottom of the frame and is fixed by binding or bonding to the frame, the two horizontal end faces of the tubular magnetic yoke go beyond the outer polar face of the upper pole plate and the lower pole plate by 0.5-20 mm of value (H) respectively in axial height, two coaxial isodiametric annular magnetic gaps are formed between the inner circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces (F) in the same direction at a working moment;

e. with the bisector axis (X-X) at half axial height of the permanent magnet as a horizontal symmetry axis and the central axis (Y-Y) of the upper pole plate, permanent magnet, and lower pole plate as a vertical symmetry axis, the dual magnetic gap and dual coil driver has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same tension when winding, and the inductances of the two coils and the back electromotive forces induced in the two coils during the reciprocating movement of the two coils offset each other due to the phase angle of 180 degree; thus, a first set of dual magnetic gap, dual coil, and inner magnet driver unit (01) having resistive load features or near-resistive load features is constituted;

f. a piece of coaxial circular or annular partition made of a non-magnetic material is bonded to the outer side of the lower pole plate of the first set of dual magnetic gap, dual coil, and inner magnet driver unit (01), and the other side of the circular or annual partition is fixed by bonding to the lower pole plate of a second set of dual magnetic gap, dual coil, and inner magnet driver unit (01) of the transducer; thus, two sets of dual magnetic gap, dual coil, and inner magnet driver unit (01) having mutually-repelling magnets are formed; in that way, another piece of coaxial circular or annual partition made of an non-magnetic material is bonded to the outer side of the upper pole plate of the second set of dual magnetic gap, dual coil, and inner magnet driver unit (01), and the other side of the circular or annular partition is fixed by bonding to the upper pole plate of a third set of dual magnetic gap, dual coil, and inner magnet driver unit (01) of the transducer; the first set, second set, and third set of dual magnetic gap, dual coil, and inner magnet driver unit (01) take the same central axis (Y-Y) as their vertical symmetry axis, and have the same coil framework, the same frame and bracket, the same tubular magnetic yoke, the circular or annular partitions in the same physical dimensions, four, six, or more annular magnetic gaps and four, six, or more coils matching the four, six, or more annular magnetic gaps; thus, a super-high sensitivity, high fidelity, and inner magnet multi-driver transducer having one or more pairs of mutually-repelling magnets, symmetrical magnetic circuits, and symmetrical coil circuits is constituted.

2. A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitutes coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils, wherein:

a. the frame is a frame made of a non-magnetic material, or the frame and the bracket are integrated into an integral frame;

b. the magnetic circuit has coaxially installed upper pole plate and lower pole plate that have at least one axial center hole respectively, and the pole plates have the same thickness and the same projected area and match a permanent magnet; the permanent magnet is an annular permanent magnet with an axial center hole or one or more uniform-thickness, uniformly distributed, and axially charged permanent magnets which bind the upper pole plate and lower pole plate into an integrated magnetic core;

c. the bracket is a bracket made of a non-magnetic material, with an inwardly protruding circular platform arranged at the central axis part, the circular platform has a axial center hole that matches the upper pole plate, permanent magnet, and lower pole plate, and has a smooth and regular vertical circumferential face, with an annular groove arranged in the outer side of the vertical circumferential face, the annular groove has two or more evenly distributed air venting through-holes in its bottom, the outer side of the annular groove constitutes an open-end tubular thin wall of the bracket, a smooth and regular horizontal positioning face and a vertical positioning face are arranged on the inner circumferential face of the tubular thin wall at a corresponding height in axial direction or on its top, and the tubular thin wall of the bracket is arranged on its top with a flange extending outwards and coupled to the frame;

d. a fastener made of a non-magnetic material passes through at least one axial center hole of the upper pole plate, permanent magnet, and lower pole plate and secures and bonds them on the central axis part of the circular platform face of the bracket, a tubular magnetic yoke coaxially mounted with the upper pole plate, permanent magnet, and lower pole plate is flush-mounted or fixed by bonding to the inner circumferential face of the tubular thin wall of the bracket, and is positioned via bonding or fixed via fitting by the vertical positioning face and horizontal positioning face, the other end of the tubular magnetic yoke is embedded in the circular axial hole in its bottom of the frame and is fixed by binding or bonding to the frame, the two horizontal end faces of the tubular magnetic yoke go beyond the outer polar face of the upper pole plate and the lower pole plate by 0.5-20 mm of value (H) respectively in axial height, two coaxial isodiametric annular magnetic gaps are formed between the inner circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces (F) in the same direction at a working moment;

e. with the bisector axis (X-X) at half axial height of the permanent magnet as a horizontal symmetry axis and the central axis (Y-Y) of the upper pole plate, permanent magnet, and lower pole plate as a vertical symmetry axis, the dual magnetic gap and dual coil driver unit has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same tension when winding, and the inductances of the two coils and the back electromotive forces induced in the two coils during the reciprocating movement of the two coils offset each other due to the phase angle of 180 degree; thus, a first set of dual magnetic gap, dual coil, and inner magnet driver unit having resistive load features or near-resistive load features is constituted;

f. a piece of coaxial circular or annular partition made of a non-magnetic material is bonded to the outer side of the lower pole plate of the first set of dual magnetic gap, dual coil, and inner magnet driver unit (01), and the other side of the circular or annual partition is fixed by bonding to the lower pole plate of a second set of dual magnetic gap, dual coil, and inner magnet driver unit (01) of the transducer; thus, two sets of dual magnetic gap, dual coil, and inner magnet driver unit (01) having mutually-repelling magnets are formed; in that way, another piece of coaxial circular or annual partition made of an non-magnetic material is bonded to the outer side of the upper pole plate of the second set of dual magnetic gap, dual coil, and inner magnet driver unit (01), and the other side of the circular or annular partition is fixed by bonding to the outer side of the lower pole plate of a third set of dual magnetic gap, dual coil, and inner magnet driver unit (01) of the transducer; the first set, second set, and third set of dual magnetic gap, dual coil, and inner magnet driver unit (01) take the same central axis (Y-Y) as their vertical symmetry axis, and have the same coil framework, the same frame and bracket, the same tubular magnetic yoke, the circular or annular partitions in the same physical dimensions, four, six, or more annular magnetic gaps and four, six, or more coils matching the four, six, or more annular magnetic gaps; thus, a super-high sensitivity, high fidelity, and inner magnet multi-driver transducer having one or more pairs of mutually-repelling magnets, symmetrical magnetic circuits, and symmetrical coil circuits is constituted.

3. A multi-driver transducer having symmetrical magnetic circuits and symmetrical coil circuits, comprising: magnetic circuits, and a frame and a bracket integrally bound to the magnetic circuits; coaxial and isodiametric magnetic gaps, and a coil framework inserted into the magnetic gaps, with mutually insulated wires wound in parallel on the coil framework which constitute coils; a vibrating diaphragm or planar sounding board bound to the coil framework and at least one damper, wherein, the vibrating diaphragm or planar sounding board is driven by the piston motion of the coil framework to vibrate and give off sound, or the vibrating diaphragm detects sound pressure variation and a corresponding audio signal is induced in the coils, wherein:

a. the frame is a frame made of a non-magnetic material, or the frame and the bracket are integrated into an integral frame;

b. the magnetic circuit has coaxially installed annual upper pole plate and lower pole plate, and the pole plates have the same thickness and the same projected area and match a permanent magnet; the permanent magnet is an annular permanent magnet or one or more uniform-thickness, uniformly distributed, and axially charged permanent magnets which bind the upper pole plate and lower pole plate into an integrated magnetic core;

c. the bracket is a bracket made of a non-magnetic material, with an inwardly protruding annular platform arranged at the central axis part, the annular platform has an inwardly protruding column arranged at its central axis part, and has a smooth and regular vertical circumferential face, with an annular groove arranged in the outer side of the vertical circumferential face, the annular groove has two or more evenly distributed air venting through-holes in its bottom, the outer side of the annular groove constitutes an horizontal positioning face and an open-end tubular thin wall of the bracket, the inner circumferential face of the tubular thin wall is arranged with a vertical positioning face at a corresponding height in axial direction, and the tubular thin wall of the bracket is arranged on its top with a flange extending outwards and coupled to the frame;

d. the upper pole plate, permanent magnet, and lower pole plate are flush-mounted or fixed by bonding to the inner circumferential face of the tubular thin wall of the bracket, a tubular magnetic yoke coaxially mounted with the upper pole plate, permanent magnet, and lower pole plate is flush-mounted or fixed by bonding to the inwardly protruding column of the bracket and is horizontally positioned by the annular platform face, the two horizontal end faces of the tubular magnetic yoke go beyond the outer polar face of the upper pole plate and the lower pole plate by 0.5-20 mm of value (H) respectively in axial height, two coaxial isodiametric annular magnetic gaps are formed between the outer circumferential face of the tubular magnetic yoke and the vertical circumferential face of the upper pole plate and the lower pole plate, two coaxial and isodiametric coils are inserted in the annular magnetic gaps, and the winding directions of the two coils and the directions of current flowing through the coils are governed, so that the coils generate electromotive forces (F) in the same direction at a working moment;

e. with the bisector axis (X-X) at half axial height of the permanent magnet as a horizontal symmetry axis and the central axis (Y-Y) of the upper pole plate, permanent magnet, and lower pole plate as a vertical symmetry axis, the dual magnetic gap and dual coil driver unit has two sets of magnetic circuits with geometric shape and magnetic features in bilateral symmetry and vertical symmetry and two sets of coil circuits with geometric shape and electrical features in bilateral symmetry and vertical symmetry; the two coils have winding directions opposite to each other after they are connected in series, and have the same cross-sectional area of electromagnetic wire, the same number of winding turns, the same coiling width, the same coil resistance, the same absolute value of coil inductance, and the same tension when winding, and the inductances of the two coils and the back electromotive forces induced in the two coils during the reciprocating movement of the two coils offset each other due to the phase angle of 180 degree; thus, a first set of dual magnetic gap, dual coil, and outer magnet driver unit (02) having resistive load features or near-resistive load features is constituted;

f. a piece of coaxial circular or annular partition made of a non-magnetic material is bonded to the outer side of the lower pole plate of the first set of dual magnetic gap, dual coil, and outer magnet driver unit (02), and the other side of the circular or annual partition is fixed by bonding to the lower pole plate of a second set of dual magnetic gap, dual coil, and outer magnet driver unit (02) of the transducer; thus, two sets of dual magnetic gap, dual coil, and outer magnet driver unit (02) having mutually-repelling magnetic features are formed; in that way, another piece of coaxial circular or annual partition made of an non-magnetic material is bonded to the outer side of the upper pole plate of the second set of dual magnetic gap, dual coil, and outer magnet driver unit (02), and the other side of the circular or annular partition is fixed by bonding to the upper pole plate of a third set of dual magnetic gap, dual coil, and outer magnet driver unit (02) of the transducer; the first set, second set, and third set of dual magnetic gap, dual coil, and outer magnet driver unit (02) take the same central axis (Y-Y) as their vertical symmetry axis, and have the same coil framework, the same frame and bracket, the same tubular magnetic yoke, the circular or annular partitions in the same physical dimensions, four, six, or more annular magnetic gaps and four, six, or more coils matching the four, six, or more annular magnetic gaps; thus, a super-high sensitivity, high fidelity, and outer magnet multi-driver transducer having one or more pairs of mutually-repelling magnets, symmetrical magnetic circuits, and symmetrical coil circuits is constituted.

4. The multi-driver transducer having symmetrical magnetic circuits and symmetrical coil circuits according to claim 1, 2, or 3, wherein, the thickness of the coaxial circular or annular partition made of a non-magnetic material fixed by bonding to the outer side of the lower pole plate of two sets of the dual magnetic gap, dual coil, and inner magnet driver unit (01) or dual magnetic gap, dual coil, and outer magnet driver unit (02) ensures that the two sets of dual magnetic gap, dual coil, and inner magnet driver unit (01) or dual magnetic gap, dual coil, and outer magnet driver unit (02) having mutually-repelling magnetic features still have two sets of magnetic circuits with geometric shape and magnetic features in bilateral symmetry and vertical symmetry and two sets of coil circuits with geometric shape and electrical features in bilateral symmetry and vertical symmetry.

5. The multi-driver transducer having symmetrical magnetic circuits and symmetrical coil circuits according to claim 1, 2, or 3, wherein, the tubular magnetic yoke can be bonded with two or more sections of tubular magnetic yokes that are in the same axial height, coaxial and isodiametric with each other in relation to the vertical symmetry axis (Y-Y), and one or more coaxial circular or annular partitions made of an non-magnetic material into an integral assembly.

6. The multi-driver transducer having symmetrical magnetic circuits and symmetrical coil circuits according to claim 1, 2, or 3, wherein, the air venting through-holes arranged in the annular groove of the bracket, which are configured to vent the heat generated by the magnetic circuits and coil circuits and reduce the air damping of the vibrating system of the transducer, and each of which has the same projected area that is as large as possible, provided that the physical dimensions and structural strength of the bracket permit; the circle center or center line of each air venting through-hole is arranged on the circumference of the projected circle of the coil framework or the coaxial and isodiametric coils, and the coil circuits are always kept in the bilateral symmetry state when the vibrating system of the transducer vibrates up and down.

7. The multi-driver transducer having symmetrical magnetic circuits and symmetrical coil circuits according to claim 1, 2, or 3, wherein, a flange is arranged on the bottom of the bracket, one end of a frame made of a non-magnetic material is fixed by binding to the flange, the other end of the frame is arranged with a flange that has a diameter larger than the diameter of the damper, an inwardly protruding platform is arranged at the central axis part of the larger flange, an inwardly protruding column is arranged at the central axis part of the inwardly protruding platform, the tubular magnetic yoke is flush-mounted or fixed by bonding to the inwardly protruding column of the flange; thus, a coaxial and isodiametric annular magnetic gap is formed; a damper is fixed by bonding to the annular platform face of the frame, and both the frame and the flange have evenly distributed heat and air venting spaces.

* * * * *